US005439301A

United States Patent [19]

Nishizawa

[11] Patent Number: 5,439,301

[45] Date of Patent: Aug. 8, 1995

[54] PRINTER CONTROLLER AND METHOD THEREOF FOR A PRINTHEAD ASSEMBLY

[75] Inventor: Katsuhiko Nishizawa, Nagano, Japan

[73] Assignee: Seiko Epson Corporation, Tokyo, Japan

[21] Appl. No.: 151,856

[22] Filed: Nov. 15, 1993

Related U.S. Application Data

[63] Continuation of Ser. No. 916,705, Jul. 22, 1992, Pat. No. 5,310,272.

[30] Foreign Application Priority Data

| | | | |
|---|---|---|---|
| Jul. 22, 1991 | [JP] | Japan | 3-180989 |
| Aug. 8, 1991 | [JP] | Japan | 3-199255 |
| Oct. 28, 1991 | [JP] | Japan | 3-281193 |
| Jun. 16, 1992 | [JP] | Japan | 4-156806 |

[51] Int. Cl.[6] ..... B41J 9/24; B41J 2/30

[52] U.S. Cl. ..... 400/124.05; 400/279

[58] Field of Search ..... 400/279, 320, 322, 157.2, 400/157.3, 166, 124.02, 124.05

[56] References Cited

U.S. PATENT DOCUMENTS

| | | | |
|---|---|---|---|
| 4,270,868 | 6/1981 | Morgan et al. | 400/322 |
| 4,421,431 | 12/1983 | Dorrfub | 400/124 |
| 4,459,050 | 7/1984 | Goldberg et al. | 400/322 |
| 4,737,924 | 4/1988 | Miki | 400/322 |
| 4,844,635 | 7/1989 | Malkemes et al. | 400/279 |
| 4,854,756 | 8/1989 | McCrimmon et al. | 400/322 |
| 5,312,193 | 5/1994 | Kringe et al. | 400/279 |

FOREIGN PATENT DOCUMENTS

| | | | |
|---|---|---|---|
| 0025893 | 4/1981 | European Pat. Off. | 400/322 |
| 0367059 | 5/1990 | European Pat. Off. | 400/322 |
| 0483371 | 5/1992 | European Pat. Off. | 400/322 |
| 0491957 | 7/1992 | European Pat. Off. | 400/322 |
| 32059 | 8/1991 | Japan | 400/322 |
| 2086109 | 5/1982 | United Kingdom | 400/322 |

*Primary Examiner*—David A. Wiecking
*Assistant Examiner*—Steven S. Kelley
*Attorney, Agent, or Firm*—Sughrue, Mion, Zinn, Macpeak & Seas; Richard C. Turner; Marie-Claire Boisvert

[57] ABSTRACT

A print controller apparatus and method thereof for controlling the movement of a printhead assembly including a carriage, printhead, and head pins. First and second moving times of the carriage moving from first and second predetermined distances and a difference between these moving times are determined. The carriage at a third predetermined distance is then determined based on the first and second moving times and the difference of the moving times. A basic timing signal corresponding to the current print mode is generated in accordance with the current moving time of the carriage. A correction value is then computed based on the current moving time of the carriage and from a preceding detected moving time which equals a predetermined time the printhead arrives at the printing paper. The basic timing signal is corrected using the correction value to thereby generate a print timing signal. In accordance with a speed signal being of an inverse proportion to the current moving speed of the carriage and with a preceding computed print timing signal, a drive signal in proportion to the speed signal causes the head pin to make contact with the printing paper for a corresponding amount of time.

4 Claims, 16 Drawing Sheets

PRINTER CONTROLLER AND METHOD THEREOF FOR A PRINTHEAD ASSEMBLY

This is a continuation of Application No. 07/916,705 filed Jul. 22, 1992, now U.S. Pat. No. 5,310,272.

BACKGROUND OF THE INVENTION

The present invention relates in general to a printer and more particularly to an apparatus and method for controlling the movement of a printhead assembly.

Conventional dot matrix printers have become very popular because they provide high quality characters and bit images at a relatively low cost. Dot matrix printers of a serial type operate by driving a head fixing base or carriage having a printhead thereon in a printing direction. The movement of the carriage is controlled by print timing signals, which are generated according to how fast or far the carriage moves relative to a slit plate.

In conventional printers, each line is printed only while the carriage is moving at a constant speed in a printing area (FIG. 17). A slit detector generates encoder signals as the carriage moves relative to the slit plate, which has slits a predetermined distance apart. The generated encoder signals are used as starting points and corresponding print timing data is set in a timer circuit in accordance with print instruction data received from an external device at timings corresponding to the respective printing modes of the printer. Once the timer circuit is set, print timing signals are generated to control the further movement of the carriage and the printhead striking the paper.

As shown in FIG. 18 herein, Japanese Patent Publication (Tokkai) No. 3-2059 of Heisei discloses a print timing control method for correcting variances in printing positions between respective dots in a transverse direction. This reference employs delay circuits 301 for controlling a drive circuit 302 which drives the respective head pins of a printhead 303. The delay circuits 301 change the delay time according to the printing direction to compensate for variances in the printing position.

Further, head pins which are provided in the printhead of a serial type printer are respectively driven at a predetermined cycle. The time for energizing a head pin driving solenoid or for applying voltage to a head pin driving piezoelectric element during one cycle is fixed independent of the moving speed of the carriage.

There is a demand for increased print speed which has resulted in an increase in the printing speed during the constant speed movement of the carriage. The demand for increased print speed has also resulted in printing during the accelerating and decelerating movements of the carriage (i.e., in the periods shown by oblique lines in FIG. 17). However, to print during the accelerating and decelerating movements of the carriage, print timings must be generated relative to the moving speed of the carriage which changes momentarily. Furthermore, during the accelerating and decelerating periods, the movement of the carriage is greatly influenced by the variations of loads occurring while controlling the print carriage drive mechanism. In conventional printers, the movement of the carriage during the accelerating and decelerating periods is based on timing signals corresponding to the print area. As a result, the printing quality is not satisfactory.

In addition, in the conventional method, the printing operations are performed in such a manner that the carriage moves without stopping to strike the head pins against the paper via a ribbon. Therefore, as the printing speed of the printer increases, the contact distance on the paper between the head pin and the paper increases thereby spreading the shapes of dots printed on the paper. The result is that the printing quality is deteriorated. Further, the change in the shape of the dot is clearly recognized as a change in the shape of a character or image especially when the printing is performed in the accelerating or decelerating movements of the carriage. The change in the dot shape is undesirable from the viewpoint of the printing quality.

SUMMARY OF THE INVENTION

Accordingly, it is an object of the invention to provide a printer having the control to print at a predetermined position on the printing paper even in the accelerating or decelerating movements of the carriage.

In accordance with the above and other objects, the present invention provides a method for generating a print timing signal for a printer having a detector which, each time a printhead carriage moves a predetermined distance, outputs a detect signal, the method including the steps of measuring first and second signal cycles based on detect signals output by the detector for first (N-2) and second (N-1) predetermined distances, respectively, determining a difference signal corresponding to a difference between the first and second signal cycles, determining a third signal cycle for a third (N) predetermined distance based on the first and second signal cycles and the difference signal, and generating the print timing signal in accordance with the third signal cycle.

Further in accordance with the above objects, the present invention provides an apparatus for generating a print timing signal for a printer having a detector which, each time a printhead carriage moves a predetermined distance, outputs a detect signal, the apparatus including measuring means, responsive to detect signals output by the detector, for measuring first and second signal cycles corresponding to first (N-2) and second (N-1) predetermined distances, respectively, difference operation means for generating a difference signal corresponding to a difference between the first and second signal cycles, operation means for computing a third signal cycle based on the first and second signal cycles and the difference signal, and print timing signal generation means for generating the print timing signal in accordance with the computed third signal cycle.

Yet, further, the invention provides a method for generating a print timing signal for a printer having a detector which outputs a detect signal, each time a printhead carriage including a printhead and head pins which move a predetermined distance towards printing paper, the method including the steps of generating successive basic timing signals in accordance with detect signals output by the detector, the basic timing signals each having a signal cycle corresponding to a current print mode of the printer, determining a correction value corresponding to the carriage moving speed based on the signal cycle of the detect signal and from a preceding signal cycle equal to a predetermined time of the head pin arriving at printing paper, and correcting the signal cycle of the basic timing signal in accordance with the correction value and outputting a print timing signal corresponding to the corrected signal cycle.

Still further, the present invention provides an apparatus for generating a print timing signal for a printer having a detector which outputs a detect signal, each time a printhead carriage including a printhead and head pins which move a predetermined distance toward printing paper, the apparatus including basic timing signal generation means, responsive to the detect signal, for generating successive basic timing signals each having a signal cycle corresponding to a current print mode, correction time operation means for generating a correction time value for a print timing signal corresponding to a moving speed of the carriage based on the signal cycle of the detect signal and from a preceding signal cycle which equals a predetermined time of the head pin arriving at the printing paper, and print timing signal generation means for correcting the signal cycle of the basic timing signal in accordance with the correction time value to provide the print timing signal.

Yet, even further, the invention provides a print control method for a printer which drives a head pin provided on a printhead to form a dot on printing paper, the print control method including the steps of detecting a moving speed of the printhead moving with respect to the printing paper and generating a speed signal having a signal cycle in inverse proportion to the detected moving speed, generating a print timing signal in accordance with preceding print timing data, generating a drive signal having a signal cycle in proportion to the signal cycle of the speed signal in accordance with the speed signal and print timing signal, and contacting the head pin with the paper only for a time corresponding to the signal cycle of the drive signal to form a dot having a predetermined length with respect to the moving direction of the printhead on the paper regardless of the moving speed.

The invention also provides a print control device of a printer for driving a head pin provided on a printhead to form a dot on printing paper, the print control device including speed signal generation means for detecting a moving speed of the printhead moving relative to the printing paper and generating a speed signal having a signal cycle in inverse proportion to the moving speed, print timing signal generation means for generating a print timing signal from preceding print timing data, drive signal generation means for generating a drive signal having a signal cycle in proportion to the signal cycle of the speed signal, and head pin drive means for contacting the head pin with the printing paper only for a time corresponding to the signal cycle of the drive signal to thereby form a dot having a predetermined length with respect to the moving direction of the printhead on the printing paper regardless of the moving speed.

DETAILED DESCRIPTION OF THE PREFERRED EMBODIMENTS

Figure 1:
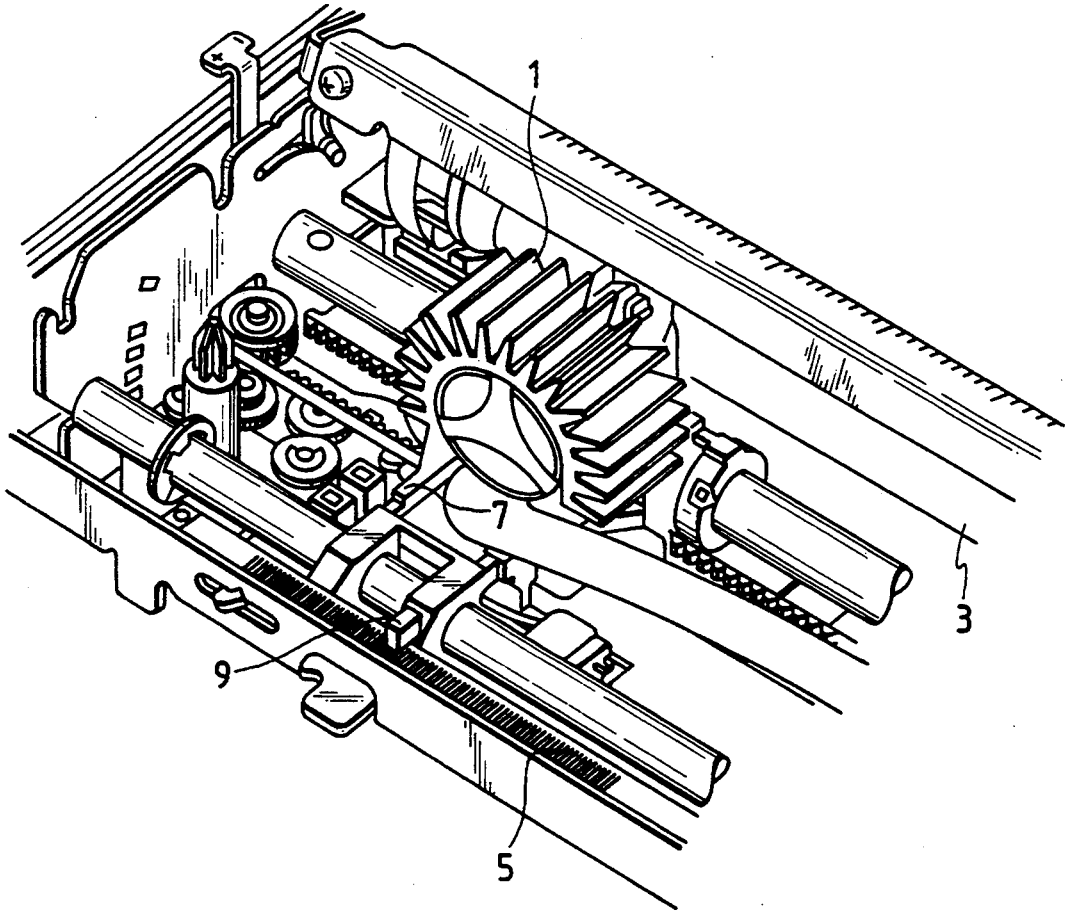
FIG. 1 shows a carriage and printhead assembly which is controlled by a print controller apparatus and method in accordance with the invention.

FIG. 1 shows a print head 1, a platen 3, a slit plate 5 which includes a plurality of slits spaced equidistant from one another, a carriage 7, and a slit detector 9 which is mounted to the carriage and serves as an encoder. To facilitate a better understanding of the invention, a ribbon cartridge and printing paper are omitted. As the carriage 7 moves, the slit detector 9 detects, for example, the number of slits passed by the carriage or the time it takes the carriage to cross adjacent slits and outputs an encoder signal ENA having a cycle corresponding to the moving speed of the carriage.

Figure 2:
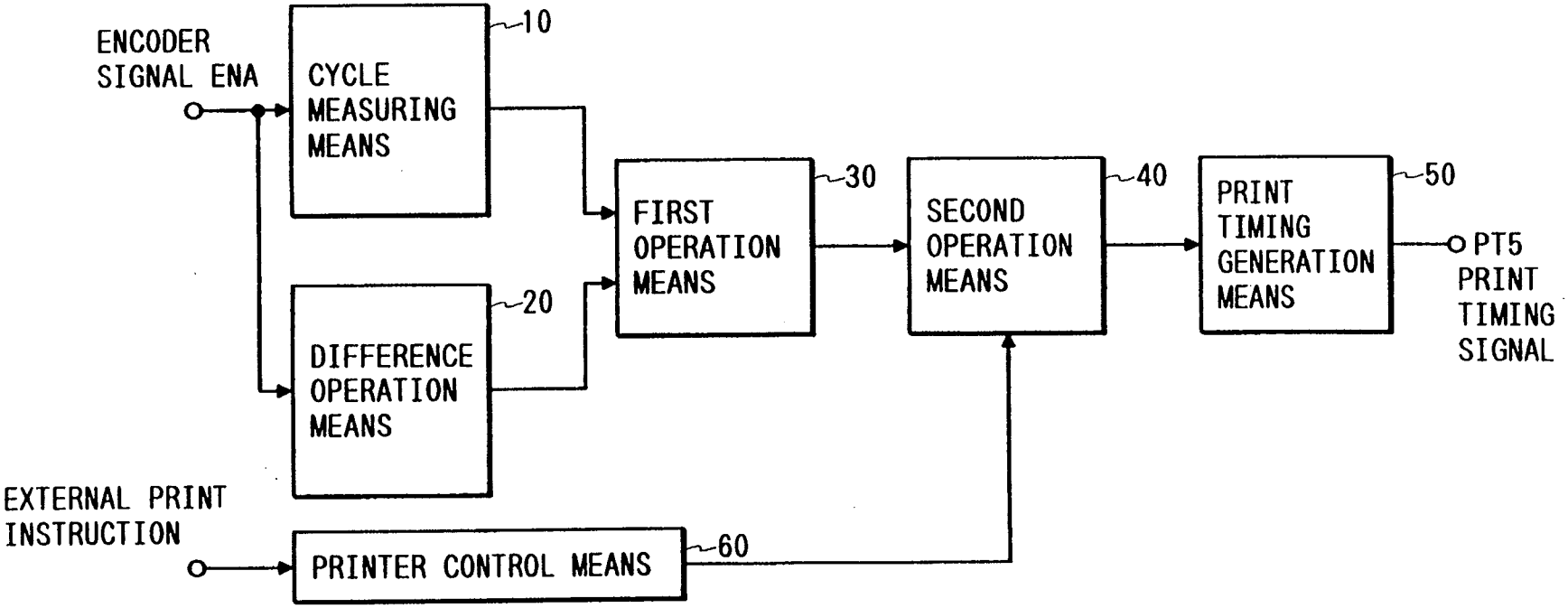
FIG. 2 is a block diagram of a printer controller circuit according to a first embodiment of the invention.

Referring to FIG. 2, the encoder signal ENA is then input to a cycle measuring means 10, which measures a cycle distance corresponding to the moving time of the carriage moving from adjacent slits, and to a difference operation means 20, which determines a difference between the cycle distances corresponding to a difference between the consecutive slit distance moving times. The outputs of the cycle measuring means 10 and difference operation means 20 are applied to a first operation means 30 which produces time data in synchronism with the generated encoder signals ENA. In accordance with data previously set in a printer control means 60, the time data produced by the first operation means 10 is applied to a second operation means 40, which outputs print timing data to a print timing generation means 50 for producing a print timing signal PTS corresponding to a current print mode of the printer.

Figure 3:
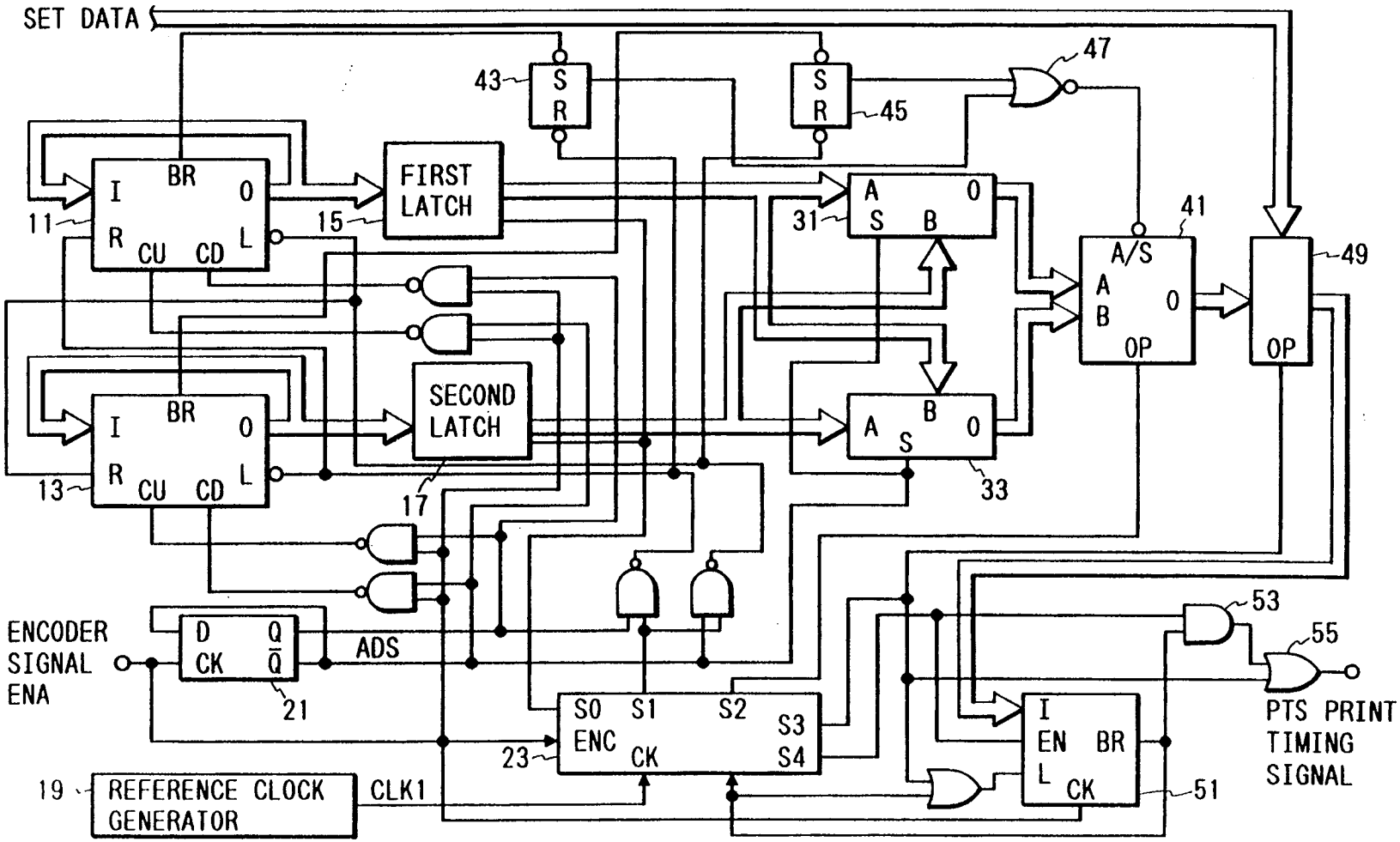
FIG. 3 is a circuit diagram of a print timing generation circuit employed in the first embodiment of FIG. 2.
Figure 4:
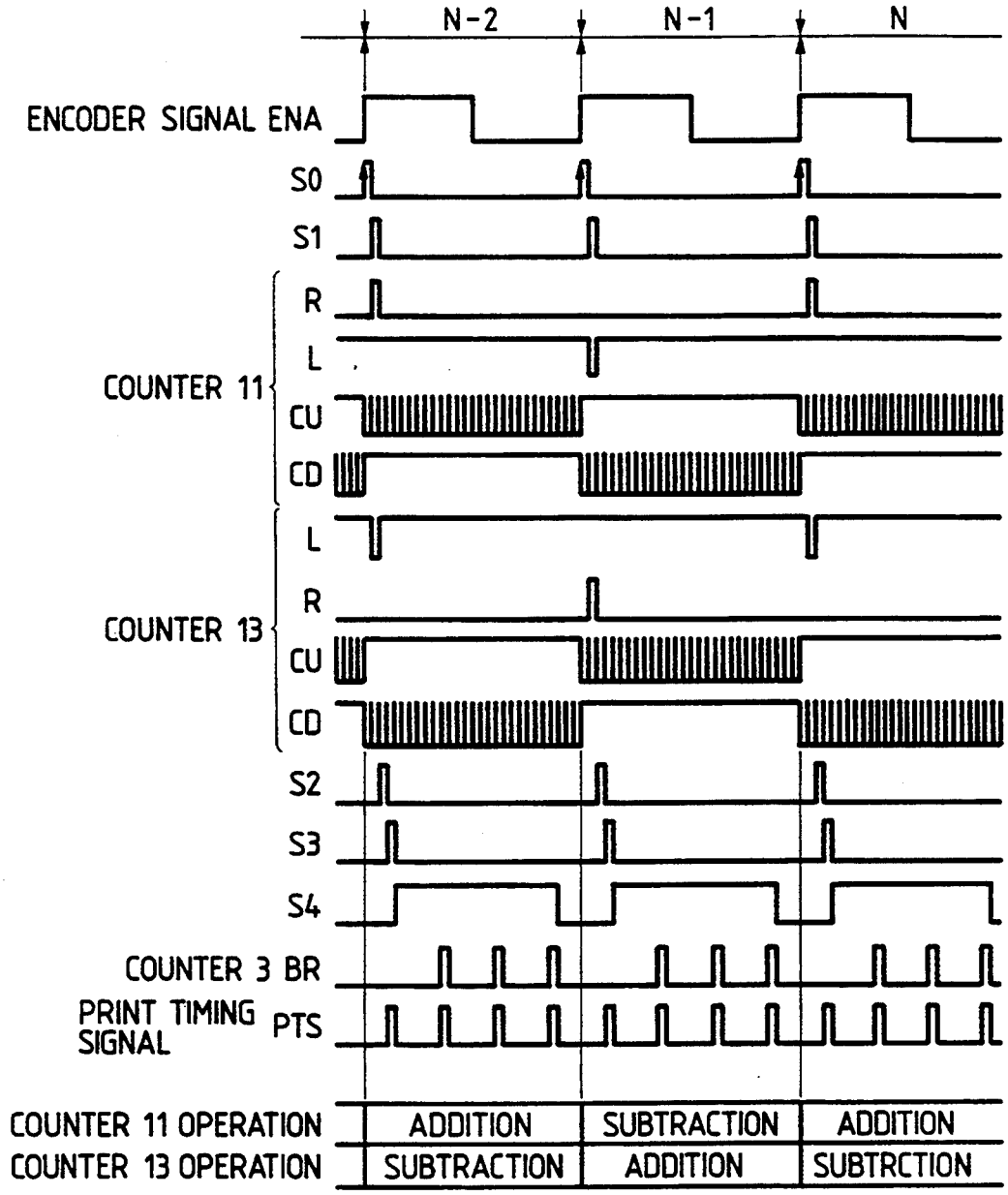
FIG. 4 is a timing chart of signals in the print timing generation circuit of FIG. 3.

Referring now to FIGS. 3 and 4, there is respectively shown a detailed circuit diagram and timing chart of the FIG. 2 block diagram, The operation of the respective means is controlled by control signals S0–S4, which are generated by a control signal generator 23 in synchronism with the rising edge of the encoder signal ENA. The cycle measuring means 10 is composed of a first counter 11, a second counter 13, and a reference clock generator 19 and, responsive to the control signal S0, the measurement values of the first counter 11 and second counter 13 are respectively latched in a first latch 15 and a second latch 17. The latches 15 and 17 serve as memory circuits storing outputs of the counters 11 and 13 during each cycle of the encoder signal ENA.

The counters 11 and 13 count the cycle distances corresponding to the moving times between respectively succeeding slit distances to measure the time for each encoder cycle. The counters 11 and 13 count in synchronism with a reference clock CLK1 generated by a reference clock generator 19.

The first counter 11 and second counter 13 also make up the difference operation means 20. A flip-flop 21 switches the mode of the counters 11 and 13 between counting up (addition) and counting down (subtraction) by outputting an addition/subtraction select signal ADS which is obtained by dividing the encoder signal ENA by one-half.

With reference to FIG. 4, an example of the operation of the first counter 11 will now be described.

When an encoder signal ENA at the N-2 slit position is input into the control signal generator 23, a control signal S1 is output. If a reset signal R is applied to a reset input of the first counter 11 as the control signal S1 is asserted, then the first counter 11 is cleared so that zero, as an initial value, is output. A clock signal CU for counting up (addition), which is selected by the addition/subtraction signal ADS, is input to the first counter 11 for initiating the counting up process of the first counter 11. When an encoder signal ENA at the N-1 slit position is input and the control signal S0 is generated, the count value of the first counter 11 is stored in the first latch 15. When the following control signal S1 is asserted, the value stored in the first latch 15 is preloaded back into the first counter 11 as an initial value by means of a setting signal L. The first counter 11 is then enabled by a clock signal CD for counting down (subtracting) which is selected by the addition/subtraction select signal ADS. The first counter 11 then begins to count down (subtraction). When an encoder signal ENA at the Nth slit position is input and the control signal SO is asserted, the count value of the first counter 11 is stored in the first latch 15. This count value provides a time difference between the moving times of the N-2 and N-1 slit positions.

The second counter 13 operates in a manner similar to the first counter but in reverse operation. That is, when the first counter 11 is counting up, the second counter is counting down and vice versa.

When the control signal S1 is asserted after detecting encoder signal ENA at the Nth slit position, a first selector 31 and a second selector 33, which collectively form the first operation means 30, selectively transfer the moving time at the N-1 slit position and the difference time between the moving times at the N-2 and N-1 slit positions, which are respectively stored in the first and second latches 15 and 17, to inputs of an adder-subtractor 41 which forms the second operation means 40.

The adder-subtractor 41 generates the moving time data for the Nth slit position. The adder-subtractor 41 either adds or subtracts the two inputs depending on the output of a circuit composed of flip-flops 43, 45 and a gate circuit 47. As a result, when the carriage 7 is in the accelerating state, the moving time decreases as the carriage 7 moves from the N-2, N-1 and Nth slits and, therefore, a borrow signal BR is not generated during the subtraction operation of the first counter 11 or second counter 13. On the other hand, when the carriage 7 is in the decelerating state, the moving time increases as the carriage 7 moves and, therefore, a borrow signal is generated during the subtraction operation of the first counter 11 or second counter 13. The borrow signal BR, when generated, provides a set signal of the flip-flop 43 or 45 and is then input through the gate circuit 47 into the addition/subtraction select terminal A/S of the adder-subtractor 41. Thus, when a borrow signal BR is generated as a result of subtraction by either the first counter 11 or second counter 13, then addition is executed by the adder/subtractor 41 and, when no borrow signal BR is generated, subtraction is executed. The flip-flops 43, 45 are reset at a subtraction start point by the setting signals L of the first counter and second counter 13, respectively.

When considered on a short time scale, the difference time of the encoder signal obtained as a result of the subtraction operation corresponds to the acceleration data (i.e., whether the carriage is accelerating or not). For this reason, determining the latest moving time and difference time for the N-2 and N-1 slit position, the moving speed of the carriage 7 can be estimated with fairly high accuracy at the slit position N and thus the print timing signal.

The time data that is obtained by the adder-subtractor 41 is then output to a subtractor 49 when the control signal S2 is asserted. The subtractor 49 generates a print timing signal in accordance with division data previously set according to the current print mode. A third counter 51, which serves as the print timing generation means 50, receives the output of the subtractor 49 as an initial value when the control signal S3 is asserted. The third counter 51 performs a subtraction process or counts down in response to the input of a reference clock, and continues to count until a borrow signal BR is generated. The borrow signal BR is used as an initial value setting signal within the N-th slit position of the third counter 51 and, each time the borrow signal BR is generated, the operation result of the subtractor 49 is loaded in the third counter 51 as an initial value. In the illustrated embodiment, a print timing signal PTS is generated every quarter of the slit clearance.

The borrow signal BR is also input to the control signal generator 23 as well so as to generate the fourth control signal S4. The control signal S4 cancels the last borrow signal BR that was generated by the output time of the subtractor 49 within the Nth slit position. The control signal S4 is also input to a gate circuit 53 which serves as an output signal select circuit. The control signal S4 eliminates the generation of an unnecessary print timing signal due to a difference between the actual moving time of the carriage 7 at the Nth slit position where the print timing signal PTS is generated and the time data obtained by the adder-subtractor 41. The borrow signal BR of the third counter 51 and the control signal S4 are input to a gate circuit 55, which generates and outputs the print timing signal PTS.

The above described series of operations are performed each time the encoder signal is generated to produce successively the print timing signals PTS during the movement of the carriage. The printer control means 60 determines whether the print timing signals PTS are generated in accordance with the print instruction of an external device (not shown) is effective or not, and controls the generation of the print timing signal corresponding to the print instruction.

In the above-mentioned embodiment, the difference time of the encoder signal, namely, the acceleration data obtained on a short time scale is taken into consideration. However, this is not limitative but, alternatively, the moving speed at the N-1 slit distance may be considered as the moving speed at the Nth slit position.

Figure 5:
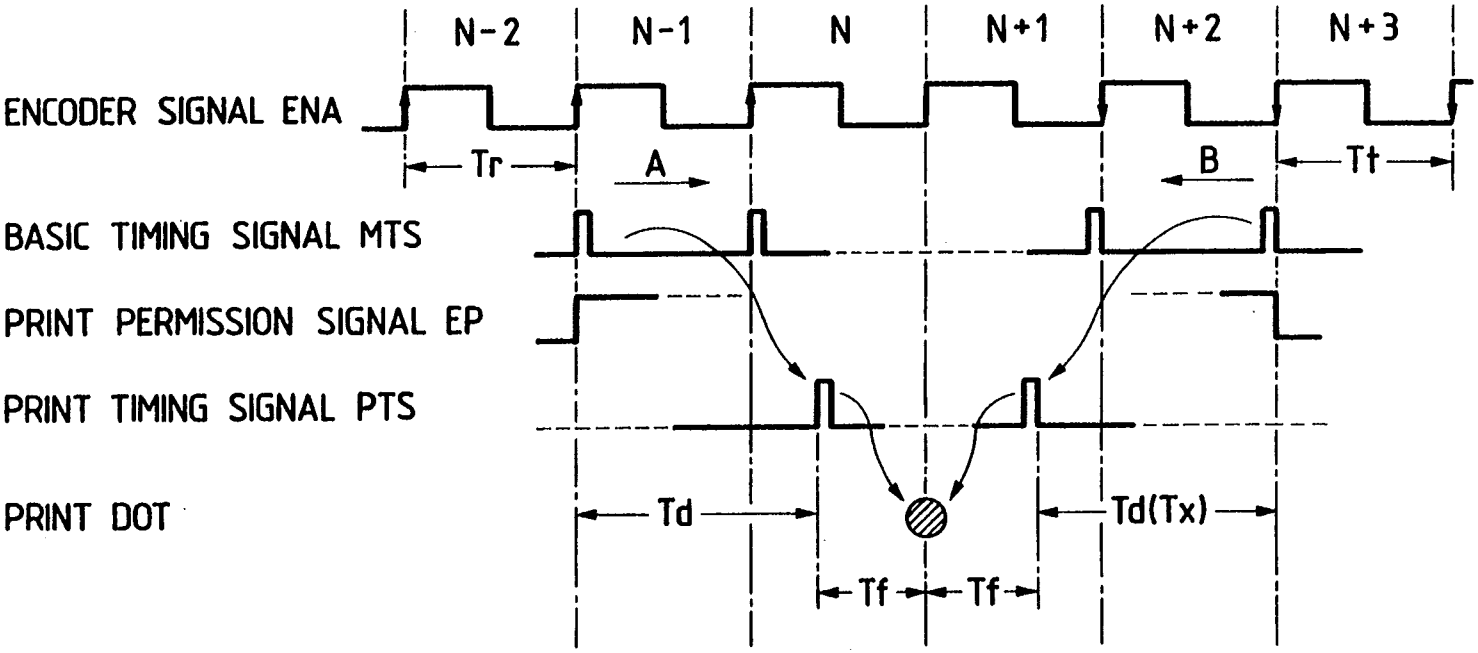
FIG. 5 is a timing chart illustrating the control principles of a second embodiment of the invention.

Next, a second embodiment according to the invention will be described with reference to FIG. 5.

When the movement of the carriage 7 is initiated by a print instruction, the slit detector 9 generates an encoder signal ENA and a control circuit generates a basic timing signal MTS which is discussed below. The basic timing signal MTS is generated for every encoder signal in accordance with previously set print timing data. When the moving speed of the head pin of the printhead 1 is constant, the delay time of the print timing corresponding to the carriage speed is as follows.

When printing is performed in a direction of arrow A (FIG. 5), if a print timing signal generation circuit, which is discussed below, is initiated in a print period (N-1) just before the Nth print period (slit position) and also the following equation with respect to the moving distance of the head pin to the printing paper at the carriage set speed is true, then a print position can be made constant regardless of the carriage speed. The delay time of the print timing corresponding to the carriage speed is expressed as:

$$V \cdot Tf = Vr \cdot (Tf - Tr + Td) \quad (1)$$

wherein:

V denotes a carriage set speed;

Vr denotes the current moving speed of the carriage;

Tr denotes the cycle of the encoder signal ENA;

Tf denotes the time the head pin arrives at the printing paper; and

Td denotes the delay time of the print timing.

If the above equation (1) is solved for the delay time Td, then the following equation is obtained:

$$Tf \cdot (V/Vr - 1) + Tr = Td \quad (2)$$

Here, if a slit distance is expressed as D, then $V = D/Ts$ and $Vr = D/Tr$, wherein Ts denotes the cycle of the encoder signal ENA with respect to the carriage set speed. If these are substituted into the above equation (2), then the following equation is obtained:

$$Tf \cdot ((Tr - Ts)/Ts) + Tr = Td \quad (3)$$

If this equation (3) is transformed, then the following equation is obtained:

$$Tf/Ts \cdot (Tr - Ts) + Tr = Td \quad (4)$$

Here, if Ts is set to equal Tf, then the above equation can be changed into the following equation (5):

$$2 \cdot Tr - Ts = Td \quad (5)$$

Thus, Td can be determined by a simple calculation if Tr can be measured. In other words, if by assuming a set speed V, which allows Ts to equal Tf, a reference print timing value is obtained when the carriage moves constantly at the assumed set speed V. If the delay time Td computed from the equation (5) is then added to the reference print timing value, then a proper print timing value can be obtained with respect to any current speed Vr within a range of speeds equal to or less than the set speed V. Therefore, the set speed V can be assumedly set at a value higher than the actual moving speed of the carriage.

Similarly, when printing in the direction of arrow B, in a print period (N+2), which is situated two periods after the Nth print period, a delay time Tx, which allows the following equation with respect to the moving distance of the head pin arriving at the printing paper at the set speed of the carriage to be true, then the print position can be made constant regardless of the speed of the carriage when printing. Furthermore, the print position is equal to the print position obtained when printing in the direction of the arrow A.

$$Vr \cdot (Tf - Tr + Td) = 3 \cdot Vr \cdot Tr - (Tf + Tx) \cdot Vr \quad (6)$$

If the above equation is solved for Tx, then the following equation (7) is obtained:

$$2 \cdot Tr - Ts = Tx \quad (7)$$

The two equations (5) and (7) are the same and, if the cycle Tr of the encoder signal ENA accompanying the movement of the carriage is measured and the cycle Ts of the encoder signal ENA corresponding to the assumed moving speed of the carriage equivalent to the moving speed of the head pin is set, then the delay time Td can be found through the simple calculation of equation (5) or (2).

If a delay circuit, discussed below, whose delay time Td is initiated at a print timing period which is previously set in accordance with the printing direction, then the print position can be controlled to be constant regardless of the printing direction. In FIG. 5, a print permission signal EP, which is responsive to the basic print timing signal MTS in each of the print periods, provides a range in which printing can occur. The delay circuit delays for a period of time Td and then the print timing signal PTS is output, which causes the print dot to be formed after the elapse of the time Tf the head pin arrives at the printing paper.

Figure 6:
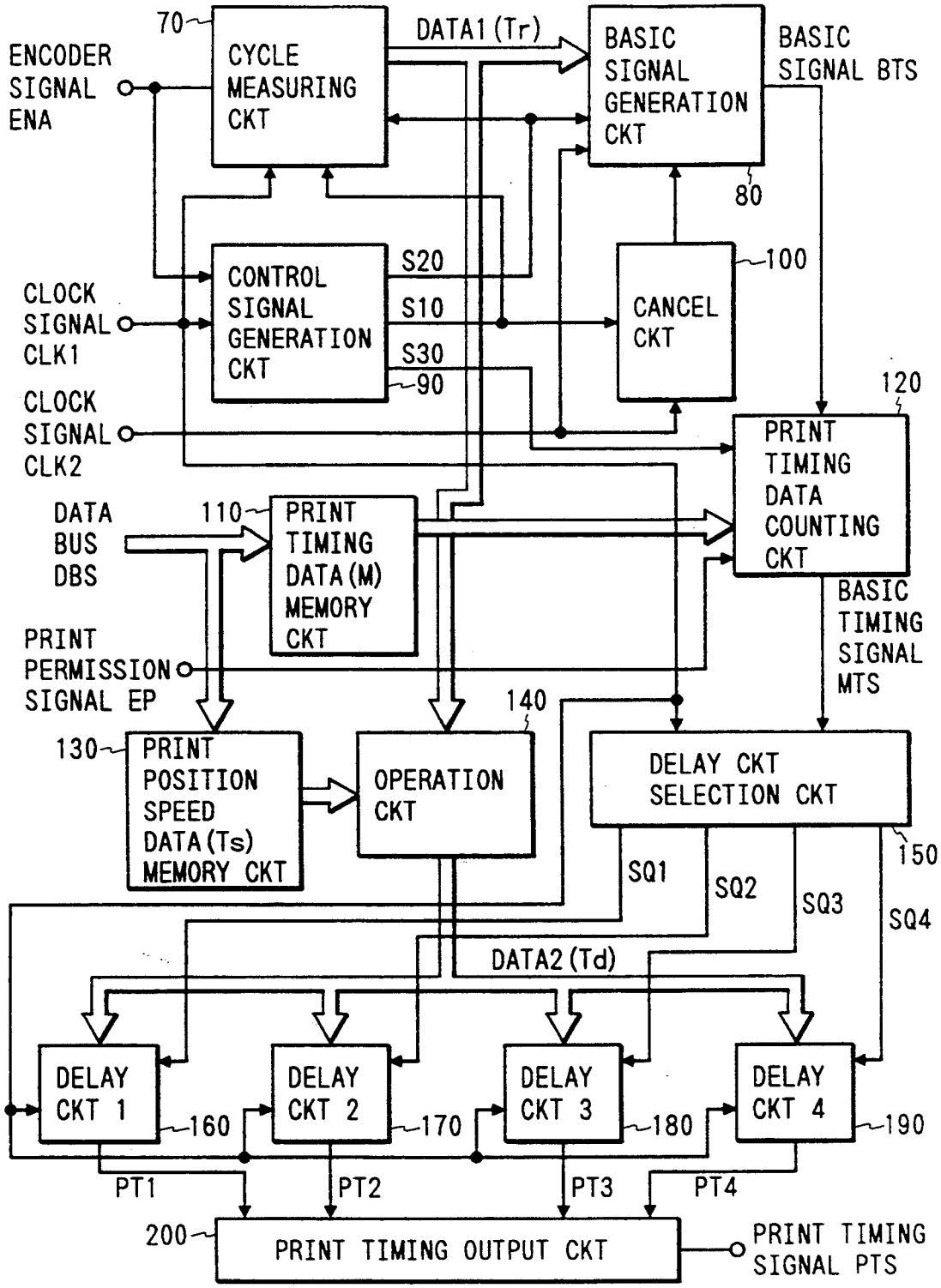
FIG. 6 is a block diagram of a printer controller circuit according to the second embodiment of the invention.

Referring now to FIG. 6, there is shown a block diagram of a controller which implements the above-mentioned operations. The controller includes a cycle measuring circuit 70 for measuring the cycle of the encoder signal ENA, (i.e., Tr from the equation (5)), and a basic signal generation circuit 80 for generating a basic signal BTS corresponding to the greatest common measure (i.e., denominator) distance of a plurality of print timing signal distances corresponding to the current print modes. For example, when there are two priority modes, one of which is performed at a dot pitch of 1/180 in. and the other mode is performed at a dot pitch of 1/120 in., there is output a basic signal BTS corresponding to a dot pitch of 1/360 in. which is the greatest common measure of the two dot pitches. Further, a plurality of dot pitches may be classified into groups and the greatest common measure may be found for each group and a basic signal BTS which corresponds to the greatest common measure is generated.

A print timing data count circuit 120 which is responsive to the basic signal BTS, generates a basic timing signal MTS in accordance with the print timing data M of the respective print modes stored in a print timing data memory circuit 110. A print position speed data memory circuit 130 stores print position speed data Ts (the set cycle of the encoder signal) corresponding to the set moving speed of the carriage. The data M and Ts are respectively set through a data bus DBS in the respective memory circuits from external circuits (not shown). A control signal generation circuit 90 generates control signals S10, S20, and S30 for respectively controlling the circuit blocks 70, 80, 100, and 120.

The cycle measuring circuit 70 counts the encoder signals ENA for every cycle in accordance with a clock signal CLK1 and the measured time data is input through a data bus Data1 into the basic signal generation circuit 80. The basic signal generation circuit 80 counts the time data in accordance with a clock signal CLK2 having a frequency which is obtained by dividing the encoder signal generation distance (slit distance) by the above-mentioned greatest common measure distance and then multiplying the resultant value by the clock signal CLK1. For example, when the encoder signal generation distance is 1/120 in. and the greatest common measure of the above-mentioned dot pitch is 1/360 in., the clock CLK2 is set such that CLK2 equals CLK1 times three.

A cancel circuit 100 compensates for the output of the basic signal BTS from variations of the cycle of the encoder signal ENA accompanying the speed variations in the accelerating or decelerating state or in the constantly moving state of the carriage. Thus, the cancel circuit 100 cancels a carry signal CY of a counter within the basic signal generation circuit 80 just before the encoder signal that starts the next measurement after the measurement of the cycle Tr of the encoder signal ENA.

An operation circuit 140 receives the data Tr and Ts and performs the calculation operation of the equation (5). The result is applied through a data bus Data2 to delay circuits 160–190, respectively. The basic timing signal MTS, which is output from the print timing data count circuit 120, is input to a delay selection circuit 150, which in turn outputs select signals SQ1–SQ4 used to select the delay circuits 160–190 in a predetermined order. The signals PT1–PT4 that are respectively generated by the delay circuits 160–190 are input to a print timing output circuit 200, which generates a print timing signal PTS corrected by means of the carriage speed thus computed.

Figure 7:
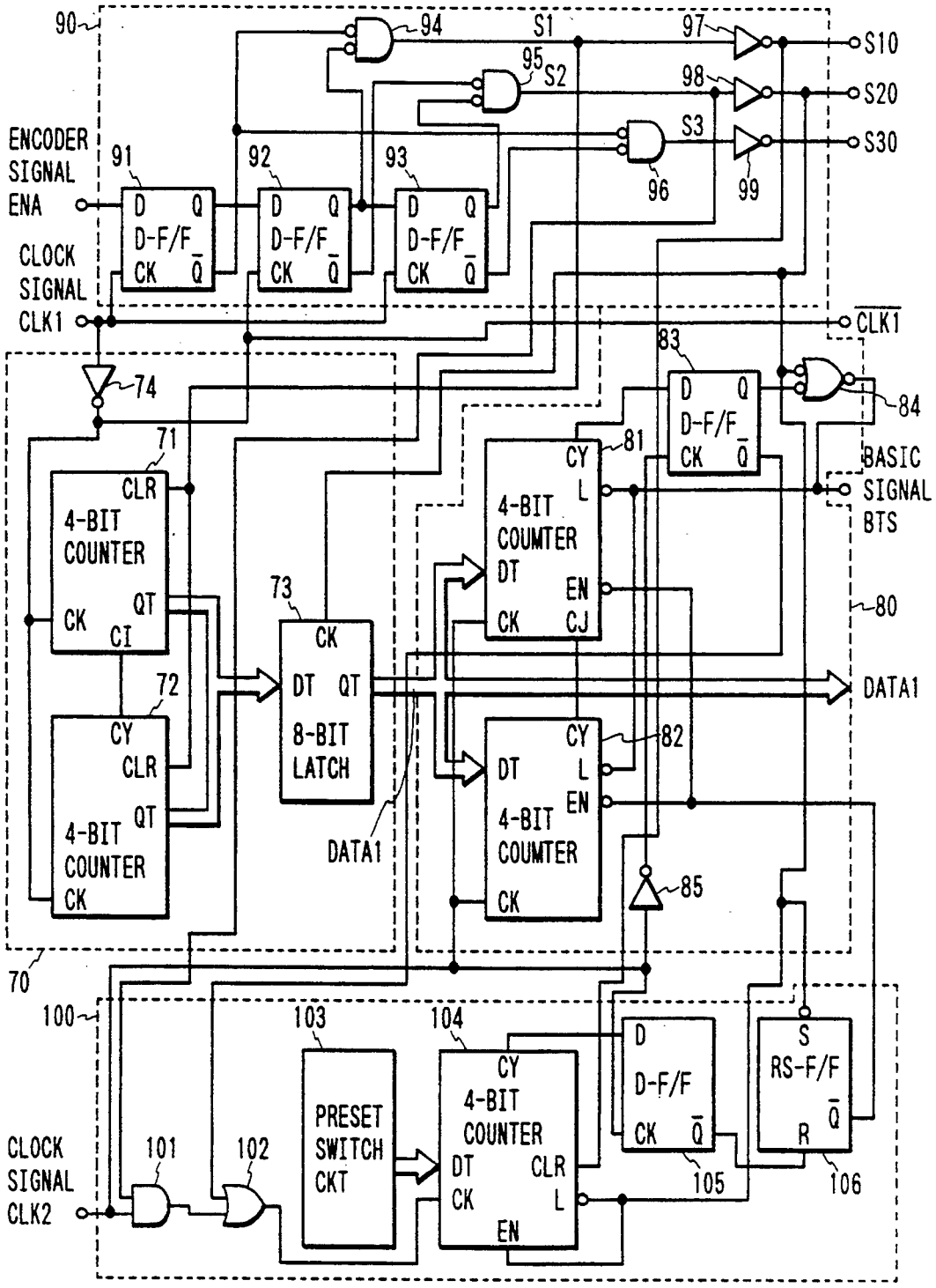
FIG. 7 is a circuit diagram of a control signal generation circuit employed in the second embodiment of FIG. 6.
Figure 8:
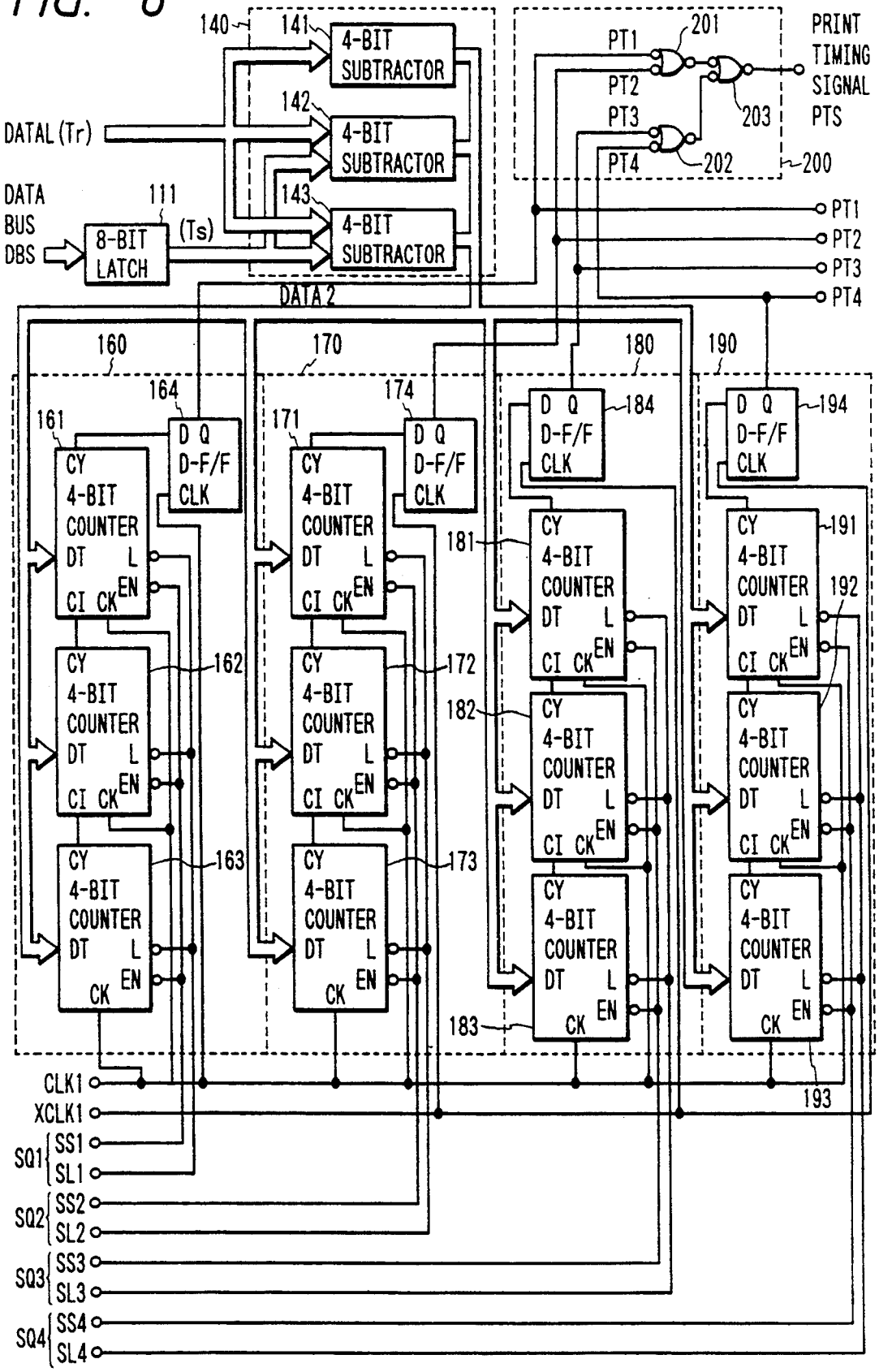
FIG. 8 is a circuit diagram of an operation circuit, a delay circuit, and a timing output circuit employed in the second embodiment: of FIG. 6.
Figure 9:
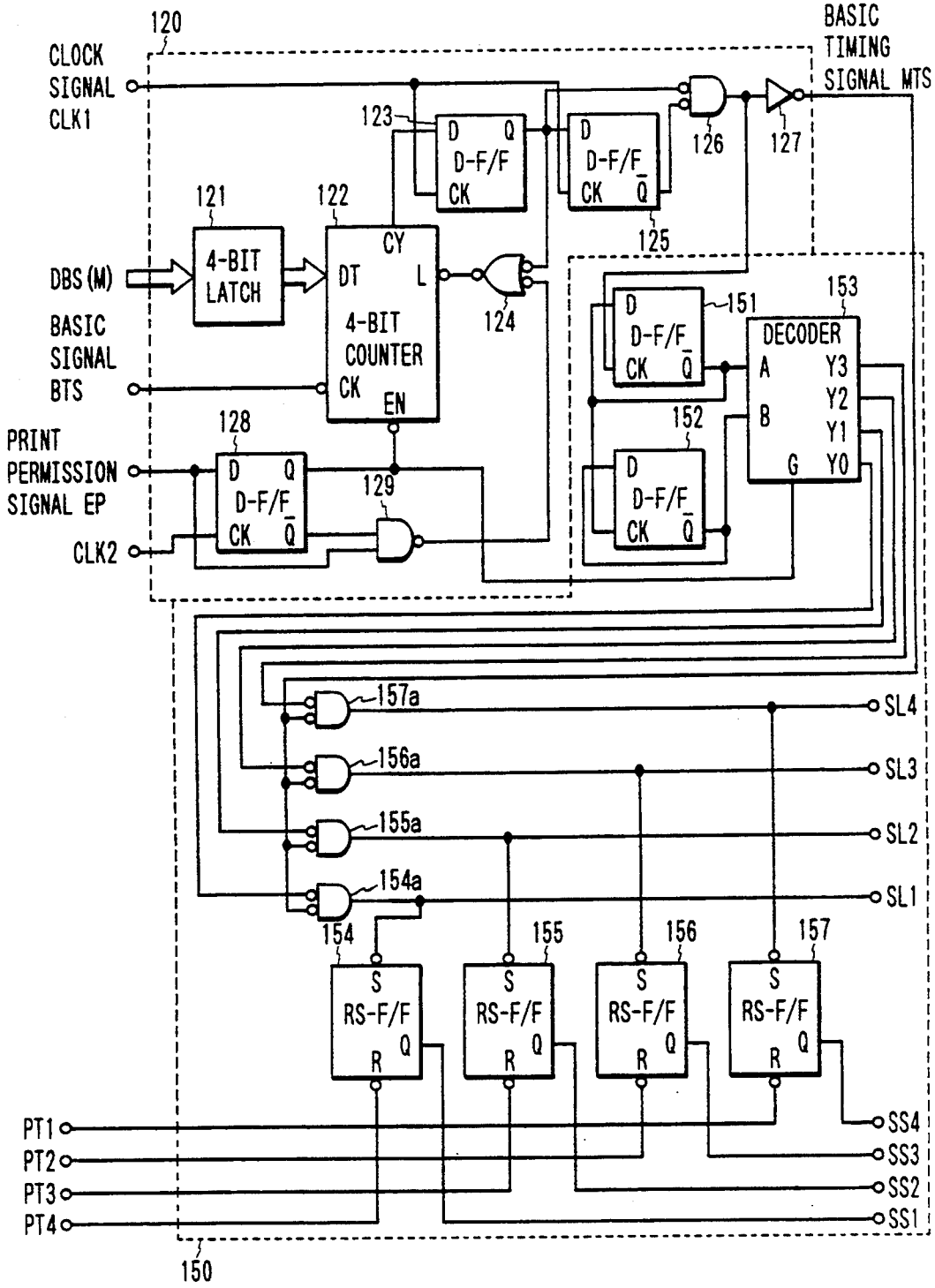
FIG. 9 is a circuit diagram of a print timing data count circuit employed in the second embodiment of FIG. 6.

Referring now to FIGS. 7, 8, and 9, there are shown the detailed circuit diagrams of the respective circuit blocks of the controller circuit of FIG. 6. The operations of the respective circuits will be described with reference to the timing chart shown in FIG. 10.

As shown in FIG. 7, the control signal generation circuit 90 includes D-flip-flops 91–93 and gate circuits 94–99. The control signal generation circuit 90 differentiates the encoder signal ENA with respect to the clock CLK1 periods and outputs control signals S10–S30. The cycle measuring circuit 70 receives the clock signal CLK1 via a gate circuit 74. The clock signal CLK1 is applied to an 8-bit counter composed of two 4-bit UP counters 71 and 72 which are cascade-connected. The two counters 71 and 72 are cleared by the control signal S10. The count output of the counters 71 and 72 is stored in an 8-bit latch 73 on each assertion of the control signal S20.

In the basic signal generation circuit 80, the time data stored in the latch 73 is loaded into two 4-bit DOWN counters 81 and 82, which are also cascade-connected. The counters count down in accordance with the clock signal CLK2 and generate a carry signal CY for each time data. The encoder signal generation distance is then divided by the above-mentioned greatest common measure and one is subtracted from the divided result. The result of the division and subtraction is set in a preset switch circuit 103 of the cancel circuit 100. A 4-bit counter 104 begins counting towards the loaded value. A D-flip-flop 105 and an RS-flip-flop 106 cancel the last carry signal CY within one cycle of the encoder signal ENA. The logical sum of the carry signal CY that is not cancelled and the control signal S20 is obtained by a gate 84 thereby generating a basic signal BTS.

In FIG. 8, the print position speed data (Ts) which corresponds to the respective print modes, are set from an external circuit (not shown) through a data bus DBS via an 8-bit latch 111 which forms the print position speed data memory circuit 110. As shown in the equation (5), the print position speed data Ts is subtracted from a value which is double the cycle measurement data Tr of the encoder signal ENA to determine the delay time Td.

Figure 10:
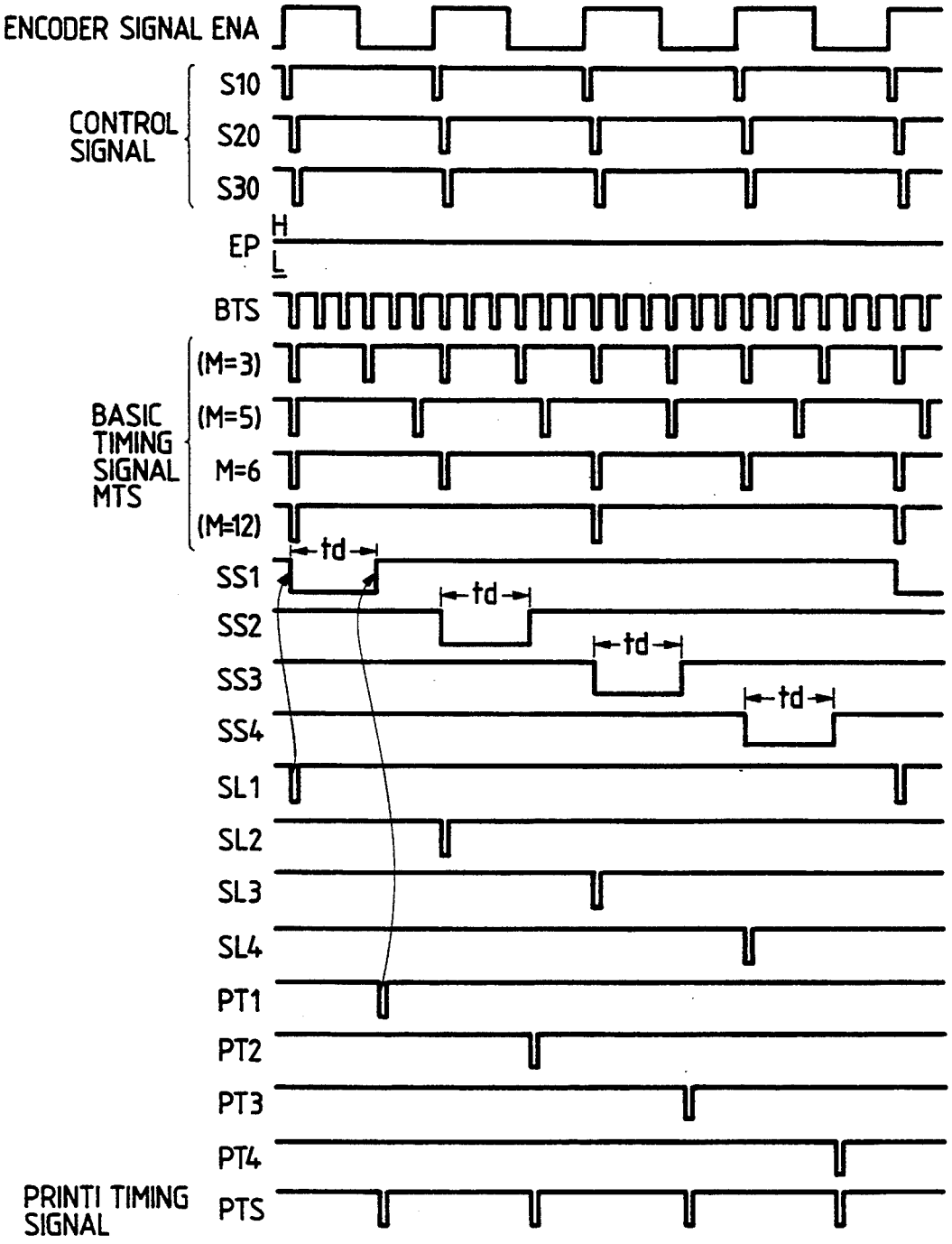
FIG. 10 is a timing chart illustrating signals in the second embodiment of FIG. 6.

An operation circuit 140, which includes three 4-bit subtractors 140, 142, and 143 cascade-connected to one another, perform the subtraction operation of equation (5). The operation circuit 140 received the data Tr shifted up one bit (thus effectively multiplying the data Tr by two) and the data Ts. The data Ts is subtracted from the data value multiplied by two and the operation circuit 140 outputs the time delay Td value to the delay circuits 160–190, via the data bus Data2. when a print timing data count circuit 120 (FIG. 9) receives the basic signal BTS, a basic timing signal MTS is generated in accordance with the print timing data M, which corresponds to the respective print modes. The print timing data M is set in a 4-bit latch 121 and, the print permission signal EP allows printing to occur, then a 4-bit counter 122 starts DOWN counting with the basic signal BTS as a clock. The counter 122 outputs the carry signal CY each time the counting has completed. When the carry signal CY is applied to D-flip-flops 123 and 125, a basic timing signal MTS corresponding to the value of print timing data M is generated through gates 126 and 127, as shown in FIG. 10.

In some cases, depending on the print position speed data Ts or the encoder cycle data Tr corresponding to the moving speed of the carriage, the delay time Td occurring due to the print speed of the carriage may exceed in length the next basic timing signal MTS. Thus, a plurality of the delay circuits which correspond to the previously expected length of the delay time Td are required. Therefore, in the second embodiment of the invention, there are provided four delay circuits 160–190. A delay selection circuit 150 (shown in FIG. 9) selects the delay circuits sequentially in accordance with the basic timing signal MTS.

In the delay selection circuit 150, there are generated delay time setting signals SL1–SL4 based on the basic timing signal MTS, which are respectively applied to the delay circuits, by D-flip-flops 151, 152, a decoder 153 and gates **154*a*–157*a*. The signals SL1–SL4 are also respectively input to RS-flip-flops 154–157 to generate the start signals SS1–SS4 of the respective delay circuits. As shown in FIG. 8, each of the delay circuits 160–190 is composed of a 12-bit counter, which is constructed by cascade-connecting three 4-bit DOWN counters to one another, and a D-flip-flop. When initiated, the delay circuits output signals PT1–PT4 after completion of counting of the delay time Td. These signals PT1–PT4 provide the reset signals of the RS-flip-flops 154–157 of the delay selection circuit and at the same time are input to the print timing output circuit 200 so that the print timing signals PTS are generated by gate circuits 201–203**.

In a period during which a series of the above mentioned operations are performed each time the encoder signal ENA is generated while the print permission signal EP permits printing, the print timing signals PTS during the movement of the carriage are generated successively.

Next, a third embodiment according to the invention will be described.

Figure 11:
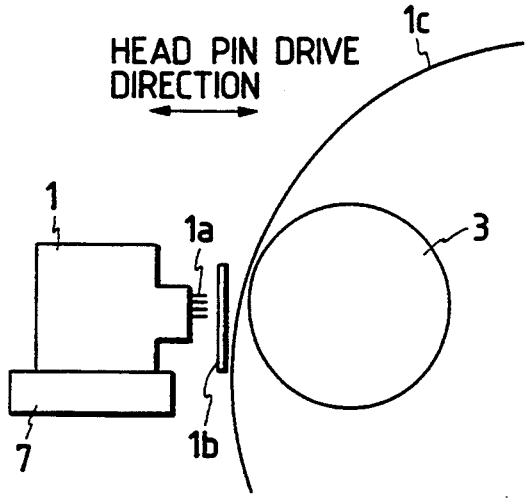
FIG. 11 illustrates a printhead and carriage and a mechanism for driving the same.

In FIG. 11, there is shown a view of a printer print mechanism employed in accordance with the third embodiment of the present invention. In this figure, reference character 1*b* designates an ink ribbon, 1*c* depicts printing paper, and 1*a* represents a head pin provided on a printhead 1. The printhead 1 is fixed to the carriage 7 and is driven by a carriage drive mechanism (not shown). The head pin 1*a* is driven in a direction of the double arrow shown in FIG. 11.

Figure 12:
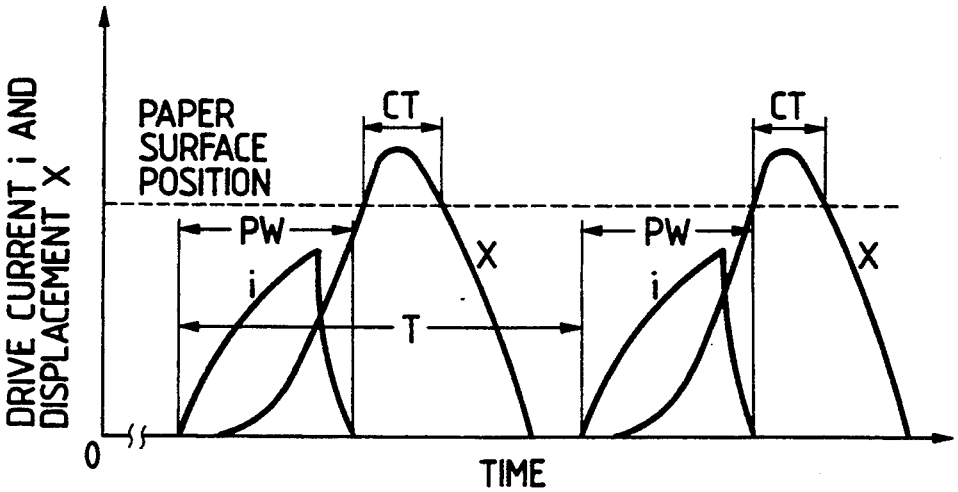
FIG. 12 illustrates drive current and displacement of a head pin according to a third embodiment of the invention.

In FIG. 12, there are shown the variations of drive current i and a head pin displacement x with respect to time when a solenoid is used to drive the head pin. If the head pin 1*a* is selected by a print instruction and drive current is allowed to flow, then a magnetic flux is generated in the magnetic circuit of the printhead, and the printhead is driven toward the printing paper 1*c* due to the magnetic force of the magnetic flux. If the head pin 1*a* is displaced due to the driving of the printhead and the leading end of the head pin 1*a* arrives through the ink ribbon 1*b* at a paper position, the begining of a dot is formed on the printing paper 1*c*. The head pin 1*a* is in contact with the printing paper 1*c* during a period of a contact time CT until the head pin 1*a* begins its return operation and moves apart from the paper position. The contact time CT depends on an energizing time PW and, as the energizing time PW increases, the contact time CT increases accordingly.

Figure 13A:
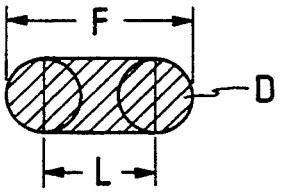
FIGS. 13(*a*) and 13(*b*) show a correlation between a carriage speed and a print dot for the third embodiment according to the invention.
Figure 13B:
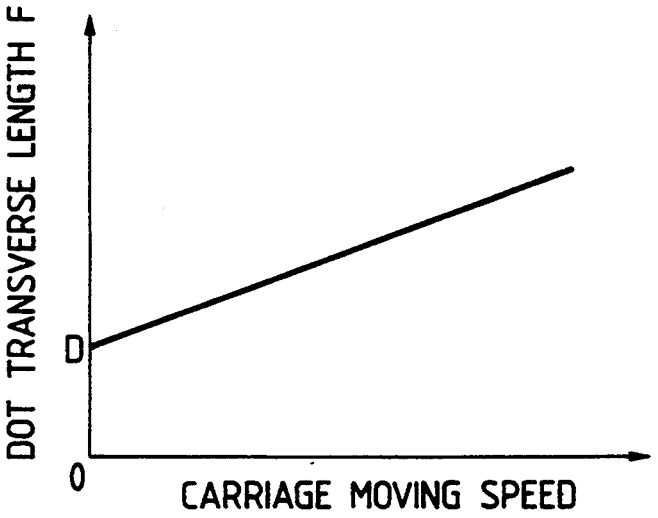

FIG. 13(*a*) illustrates an ideal shape for a dot on a printing paper. Assuming that the head pin has a circular section and the diameter of the circular section is expressed as D, if the carriage 7 is moved by a distance L in a transverse direction in accordance with the contact time CT, then the front end of the head pin is also moved by the distance L on the paper, so that the length F in the transverse direction of the dot being formed is equal to the distance L plus the diameter D. Since the distance L varies according to the carriage moving speeds, the dot transverse length F, as shown in FIG. 13(*b*), increases in proportion to the carriage moving speeds. The present invention controls the dot transverse length F so that it remains constant.

Figure 14:
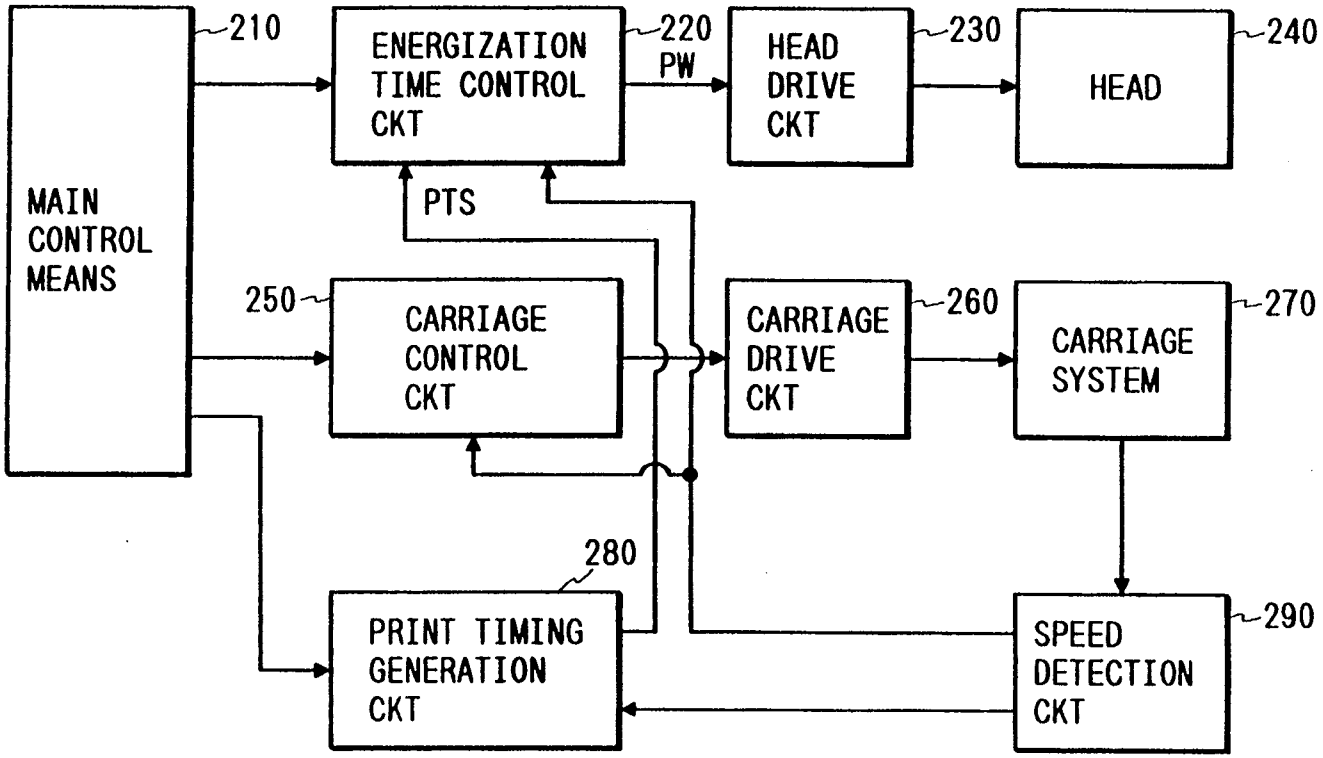
FIG. 14 is a block diagram of a print controller circuit of the third embodiment according to the invention.

Referring now to FIG. 14, there is shown a block diagram of a printer control circuit according to the present invention. A main control means 210, which is composed of a CPU for example, transmits initial energizing time data corresponding to the response frequencies of the print head 1 to energize a time control circuit 220, print speed setting data corresponding to the print operation to a carriage control circuit 250, and print timing setting data to a print timing generation circuit 280. The carriage control circuit 250 generates the speed data of the carriage 7 detected by a speed detect circuit 290 and the print speed setting data to find a speed deviation, and then outputs to a carriage drive circuit 260, a drive signal which corrects the speed deviation thereby controlling a motor of a carriage system 270. The print timing generation circuit 280, in accordance with the detected speed data and print timing setting data, outputs to the energizing time control circuit 220, a print timing signal PTS corresponding to a print style instructed from an external computer (not shown). The energizing time control circuit 220 receives as inputs the detected speed data and print timing signal PTS, and corrects the previously set initial energizing time data with the detected speed, synchronizes the corrected energizing time data with the print timing signal PTS, and then outputs the same to a head drive circuit 230.

In the present embodiment, the print timing signal PTS has been described when it is generated in synchronization with the detected speed signal. However, this is not limiting but, alternatively, the print timing signal PTS may be time controlled and generated in the main control means 210, without synchronizing the same with the detected speed signal.

Figure 15:
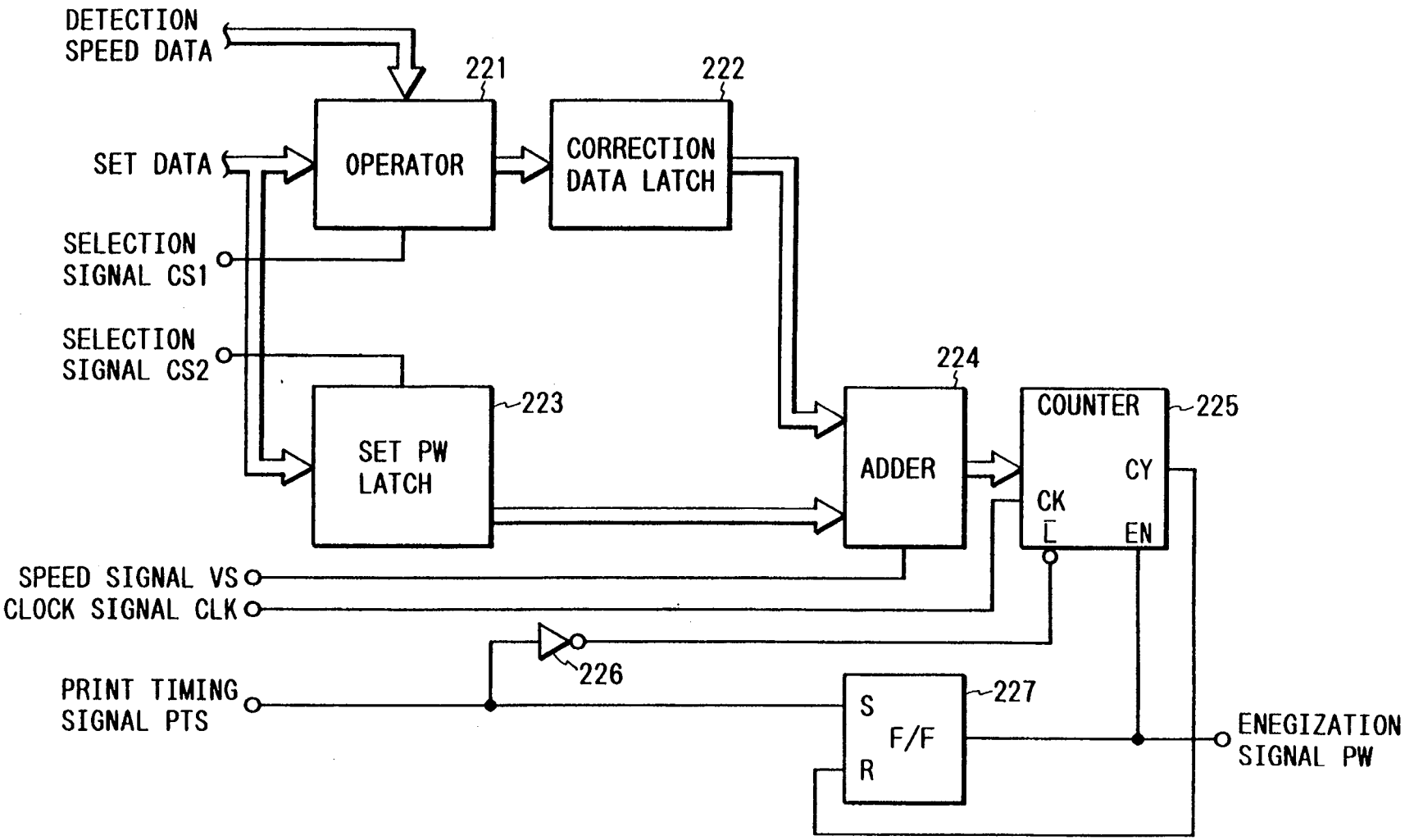
FIG. 15 is a circuit diagram of an energization time control circuit employed in the third embodiment of FIG. 14.

In FIG. 15, there is shown a detailed embodiment of the energizing time control circuit 220. The operation of the present embodiment will be described below with reference to FIG. 16 which shows the print timing signal PTS, the carry signal CY, and the energization signal PW.

The energizing time control circuit 220 is controlled by the main control means 210 to store the initial energizing time data in a setting PW latch 223 in accordance with a select signal CS2, and to store data, which is used to operate the energizing time corresponding to the detected speed data in an operator 221 also in accordance with the select signal CS2. The speed data, which is detected by measuring the cycle of the speed signal VS inputted to the speed detect circuit 290, is output to the operator 221, which in turn produces an energizing time correction value corresponding to the detected speed from the previously set operating data and the detected speed data and stores the correction value in a correction data latch 222.

Figure 16:
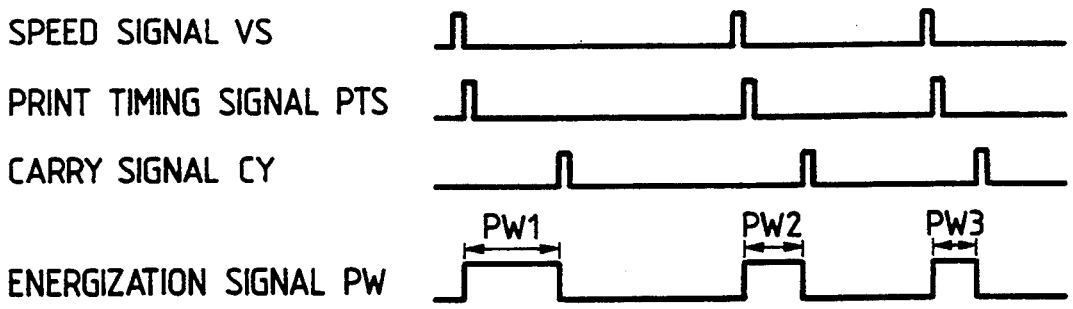
FIG. 16 is a timing chart of signals generated by the circuit of FIG. 15.
Figure 17:
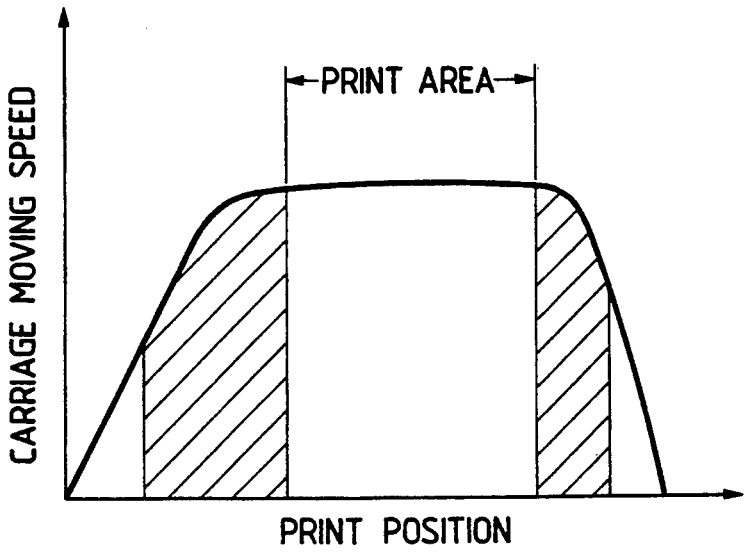
FIG. 17 illustrates a conventional print method.
Figure 18:
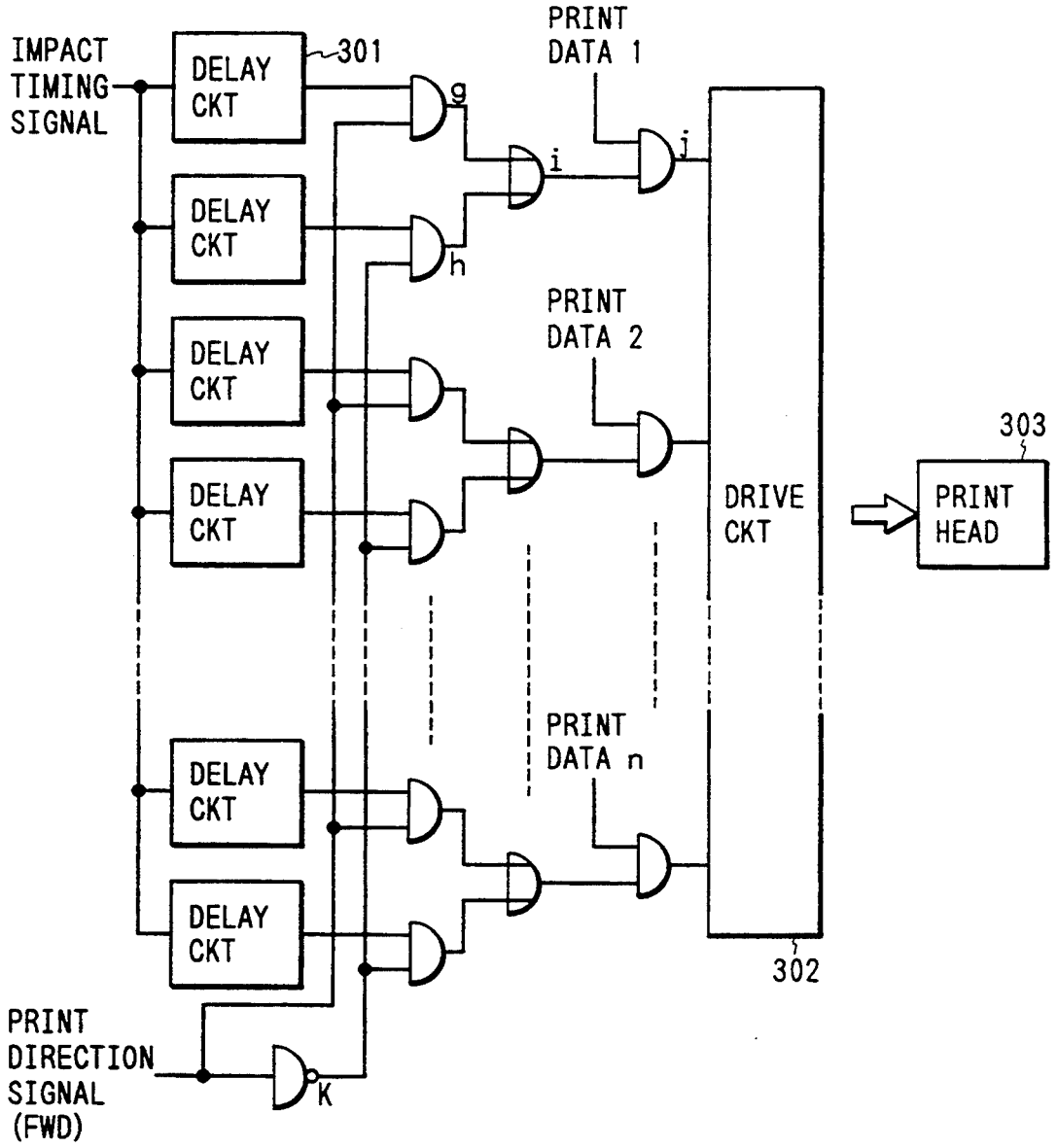
FIG. 18 PRIOR ART
FIG. 18 is a block diagram of conventional print control circuits.

In accordance with the speed signal VS, the energizing time data stored in the setting PW latch 223 is added to the energizing time correction value stored in the correction data latch 222 by an adder 224, so that an energizing time PW1 which corresponds to the speed detected is obtained. In accordance with the inverse of the print timing signal PTS through an inverter 226, the energizing time PW1 is stored as count data in a counter 225. The print timing signal PTS sets a flip-flop 227, which outputs an energizing signal PW to the head pin drive solenoid and also enables the counter 225 to begin counting. The counter 225 counts in synchronism with the clock signal CLK and outputs a carry signal CY when the counting is completed. The carry signal CY resets the flip-flop 227 and outputs a signal which negates the energizing signal PW. At the same time, the carry signal CY disables the counter 225 from counting. From this point on, each time the speed signal VS is input, the energizing signal PW corresponding to the detected speed is applied to the head pin drive solenoid in accordance with the detected speed data. The operation data of the operator 221 is set in such a manner that, when the detected speed is gradually increased as shown in FIG. 16, then the energizing time is decreased like PW2 and PW3. When the carriage speed reaches a constant moving speed, the energizing time provides substantially the energizing time data that is initialized.

In the present embodiment, the print timing signal PTS corresponds to the detected speed signal VS. However, according to some print instructions, a print timing signal not synchronous with a detected speed signal, may be generated and an energizing signal PW may be output in synchronization with such print timing signal.

There has thus been shown and described a novel printer controller and method thereof for a printhead assembly which fulfills all the objects and advantages sought therefor. Many changes, modifications, variations, and other uses and applications of the subject invention will, however, become apparent to those skilled in the art after considering the specification and the accompanying drawings which disclose preferred embodiments thereof. All such changes, modifications, variations, and other uses and applications which do not depart from the spirit and scope of the invention are deemed to be covered by the invention which is limited only by the claims which follow.

What is claimed is:

1. A printhead pin control method for a printer having a detector which outputs a detect signal each time a printhead carriage moves a predetermined distance, said printhead pin control method comprising the steps of:

measuring first and second signal cycles based on detect signals output by the detector for first (N-2) and second (N-1) predetermined distances, respectively;

determining a difference signal corresponding to a difference between said first and second signal cycles;

detecting a current moving speed of the printhead moving with respect to the printing paper based upon said first and second signal cycles and said difference signal and generating a speed signal having a signal cycle in inverse proportion to said detected moving speed;

generating a drive signal having a signal cycle in proportion to the signal cycle of said speed signal in accordance with said speed signal; and contacting a head pin provided on said printhead with said paper only for a time corresponding to the signal cycle of said drive signal to form a dot having a predetermined length with respect to the moving direction of said printhead on said paper;

wherein said measuring step and said determining step together comprise the steps of counting up, with a first counter, during a period corresponding to the first (N-2) predetermined distance to generate said first signal cycle, and counting down, with said first counter, during a period corresponding to the second (N-1) predetermined distance to generate said difference signal, and counting up, with a second counter, during a period corresponding to the second (N-1) predetermined distance, and counting down, with said second counter, during a period corresponding to the first (N-2) predetermined distance to generate said second signal cycle.

2. The method as defined in claim 1, further comprising the steps of:

correcting previously set drive time data by means of said speed signal;

generating a drive signal in accordance with said corrected drive time data; and, synchronizing said drive signal with said print timing signal and then applying said drive signal to said head pin.

3. A printer control device of a printer for driving a head pin provided on a printhead to form a dot on printing paper, said printer control device comprising:

a detector which outputs a detect signal each time a printhead carriage moves a predetermined distance;

measuring means, responsive to detect signals output by said detector, for measuring first and second signal cycles corresponding to first (N-2) and second (N-1) predetermined distances, respectively;

difference operation means for generating a difference signal corresponding to a difference between said first and second signal cycles;

speed signal generation means for detecting a current moving speed of said printhead mowing relative to the printing paper based on said first and second signal cycles and said difference signal and generating a speed signal having a signal cycle in inverse proportion to said current moving speed;

printing timing signal generating means for generating a print timing signal based on said first and second signal cycles and said difference signal;

drive signal generating means for generating a drive signal having a signal cycle in proportion to the signal cycle of said speed signal; and head pin drive means for contacting said head pin with said printing paper only for a time corresponding to the signal cycle of said drive signal to thereby form a dot having a predetermined length with respect to the moving direction of the printhead on the printing paper regardless of said current moving speed;

wherein said measuring means and said difference operation means comprise first and second counters, said first counter counts up during a period corresponding to the first (N-2) predetermined distance to generate said first signal cycle and counts down during a period corresponding to the second (N-1) predetermined distance to generate said difference signal, and wherein said second counter counts up during a period corresponding to the second (N-1) predetermined distance and counts down during a period corresponding to the first (N-2) predetermined distance to generate said second signal cycle.

4. The printer control device as defined in claim 3, further comprising operation means for computing a third signal cycle based on said first and second signal cycles and said difference signal, wherein said operation means comprises an adder-subtractor for generating said third signal cycle by adding said first signal cycle to said second signal cycle when said difference signal is a positive value and subtracting said second signal cycle from said first signal cycle when said difference signal is a negative value.

* * * * *